United States Patent [19]

Wilka

[11] 4,370,138

[45] Jan. 25, 1983

[54] INSTALLATION FOR SUPPORTING A BOAT ENGINE INSTALLED INBOARD AT A TRANSOM PLATE

[75] Inventor: Josef Wilka, Munich, Fed. Rep. of Germany

[73] Assignee: Bayerische Motoren Werke A.G., Munich, Fed. Rep. of Germany

[21] Appl. No.: 920,696

[22] Filed: Jun. 30, 1978

[30] Foreign Application Priority Data

Jul. 2, 1977 [DE] Fed. Rep. of Germany ..... 2729963

[51] Int. Cl.[3] ..... B63H 1/14

[52] U.S. Cl. ..... 440/112

[58] Field of Search ..... 115/34 R, 35; 248/4, 248/9, 20, 636, 637; 308/237 R, 238, 53.1; 440/49, 53, 111, 112

[56] References Cited

U.S. PATENT DOCUMENTS 3,020,036 2/1962 Kleinschmidt ..... 308/57.1 R 3,529,564 9/1970 Osswald et al. ..... 115/34 R 3,865,068 2/1975 Haasl ..... 115/34 R

*Primary Examiner*—Charles E. Frankfort

*Assistant Examiner*—Jesús D. Sotelo

*Attorney, Agent, or Firm*—Paul M. Craig, Jr.

[57] ABSTRACT

An installation for the support of an inboard engine at a transom plate connected with the boat transom for an outboard drive of a propeller, in which a neck secured at the boat engine and receiving the connecting shaft between the boat engine and the outboard drive is inserted into an aperture of the transom plate and is connected with the transom plate, respectively, with the aperture thereof by way of an elastic element surrounding the neck; the elastic element is retained at the neck by axially clamping its inner circumferential area and axially clamping its outer circumference area at the transom plate while a radially and axially elastic section which is not clamped is provided between these two clamping areas.

11 Claims, 4 Drawing Figures

18
17
16
20
19'
20'
19
18'
17'
21
15

5
34
4
2
3
28
26
8
24
14
13
27
30
35
29
31
22
15
32
12
16
25
23
10
11
9
7

INSTALLATION FOR SUPPORTING A BOAT ENGINE INSTALLED INBOARD AT A TRANSOM PLATE

BACKGROUND AND SUMMARY OF THE INVENTION

The present invention relates to an installation for the support of an engine installed inboard of a boat at a transom plate connected with the boat transom for the outboard drive of a propeller, in which a neck secured at the boat engine and accommodating the connecting shaft between the boat engine and the outboard drive is introduced into an aperture of the transom plate and is operatively connected with the transom plate, respectively, with the aperture by way of an elastic element surrounding the neck, which is retained at the neck by axial clamping in its inner circumferential area.

Such an arrangement is already disclosed in the U.S. Pat. No. 3,865,068. In this installation, the neck connected with the boat engine includes an offset in its free end area. A ring-shaped element of elastic material is mounted over this offset. The ring-shaped element is clamped in between a clamping sleeve and a collar at the offset by way of the clamping sleeve which is centered at the offset and is adapted to be threadably secured from the end face of the neck. The clamping in the axial direction of the ring-shaped element is so selected that the ring-shaped element expands in the radial direction and thereby comes into abutment at the wall surrounding the neck at a slight distance, of the aperture of the transom plate receiving the neck.

This prior art arrangement entails considerable disadvantages. As a result of the small annular gap between the neck and the wall of the aperture in the transom plate, only a small proportion of the ring-shaped element is available for the elastic support of the boat engine. As a consequence of the relatively strong clamping-in of the element, on the one hand, and the volumetrically slight proportion, on the other, a very hard bearing support of the boat engine results without significant vibration damping. A further considerable disadvantage resides in the complicated assembly of the prior art installation. The aperture in the transom plate has a section smaller in diameter adjoining the bearing support area for the elastic element. This requires during the installation of the boat engine into the boat that the clamping sleeve provided for the interaction on the ring-shaped element has to be mounted at the neck. In order not to render more difficult or even impair altogether the introduction of the neck into the aperture by a radially expanded element, the clamping sleeve is to be screwed tight only after the insertion of the neck. Finally, if the prior art installation is provided for a boat engine which, in its other end section, is also yieldingly supported in the axial direction by way of further elastic bearing supports, the wall of the aperture in frictional connection with the elastic ring-shaped element must have a high surface quality or surface finish. If the high surface quality or surface finish connected with considerable manufacturing costs is not present, then the ring-shaped element is destroyed at its abutment surface cooperating with the wall by the constant axial movements of the boat engine. The element thus loses its sealing action against penetrating sea water. A re-tightening or re-clamping of the element by way of the clamping sleeve for obviating this defect, however, is not possible since the clamping sleeve with its clamping flange, at which engages the threaded connection, at the same time fixes a roller bearing for the connecting shaft between the boat engine and the drive of a propeller, which is arranged in the neck.

It is the aim of the present invention to so further improve an arrangement for the support of the aforementioned type that with a simple construction, a sufficiently elastic yieldingness of the element is achieved in the radial and axial direction during movements of the boat engine and a speedy, easy assembly of the boat engine at the transom plate as well as a completely satisfactory sealing against sea water are attained. The underlying problems are solved according to the present invention in that the element is retained at the transom plate by an axial clamping action in its outer circumferential area and a radially and axially yielding section free of clamping means (working area) is provided between the two clamping areas.

An element with an inner and an outer clamping area is provided by the present invention, whereby the area disposed therebetween can be freely selected in its size in an advantageous manner for the radial and axial yieldingness of the element corresponding to the frame conditions (for example, weight of the boat engine, type of the boat drive, vibration damping).

In order not to influence significantly the characteristics of this intermediate area by the inner and outer axial clamping-in of the element, the element according to a further feature of the present invention includes within both clamping-in areas, pressure-resistant means limiting the deformation of the element. With this construction, the intermediate or working area of the element provided for the radial and axial yieldingness can be far-reachingly kept free in its values determined by its designer from any influence by the deformations existing in the two clamping areas. For the person carrying out the assembly of the element, a significant simplification results during the assembly by the devices limiting the deformations of the element within the clamping areas.

A simple assembly which can be carried out easily and speedily is achieved with an element of the preferred construction, according to which the element is constructed ring-shaped of rubber-like material and this bearing support ring includes at the end faces thereof endless (closed) circumferential bulges or beads within the clamping areas, between which rings arranged adjacent one another at a mutual spacing are provided in the bearing support ring on the side of the neck as also on the transom plate side as means for the deformation limitation. The rings which are proposed as inserts in the bearing support ring or in the elastic element, may be arranged near the radially inner and outer boundary of the working area of the element or of the bearing support ring. This has as a consequence that the material of the bulges or beads which deform during the clamping, are forced within the clamping areas radially inwardly toward the neck, respectively, radially outwardly toward the transom plate, as a result of which the bearing support ring sealingly cooperates well both with the neck of the boat engine as also with the transom plate.

A simple configuration of the arrangement for the support of an inboard boat engine at a transom plate which is advantageous in construction, is achieved by means of a bearing support ring which is frictionally retained by way of its outer circumference in a recess of a clamping ring constructed L-shaped in cross section and which is axially clamped-in by means of threaded connections against an abutment surface of the transom plate by way of the clamping ring guided by centering means. Preferably, the abutment surface at the transom plate is arranged inboard and the threaded connections of the clamping ring are provided from the outboard side. The abutment surface, against which the bearing support ring is clamped with one of its outer end-face bulges or beads by way of the clamping ring, is constructed flat for achieving low manufacturing costs. The threaded connection which is adapted to be carried out from the outboard, results in a good accessibility to the opening picture provided in the transom plate for bolts or screws and enables from the outboard side a visual control of all screws or bolts without special expenditures. This is of considerable significance for the arrangement for the bearing support in connection with its further function of sealing against sea water.

A shortest possible assembly time and a completely satisfactory alignment of the boat engine with the outboard drive are finally attainable according to a further feature of the present invention in that the bearing ring and the clamping ring are combined together with a clutch bell including the neck and secured at the boat engine and in that a clamping sleeve which is centered at the neck and which presses the bearing ring in its clamping place on the side of the neck against a step in the transition area from the neck to the clutch bell, is equipped with a flange for a folding bellows arranged essentially coaxially to the connecting shaft.

With the construction of the flange for the folding bellows at the clamping sleeve, on the one hand, and with the flat abutment surface at the transom plate, on the other, a transom plate results in an advantageous manner of extremely simple construction which leads to low manufacturing costs of the transom plate preferably made as casting. Finally, also the expenditures in mechanical machining of the transom plate are considerably lower for the installation for the bearing support of an inboard motor at the transom plate. Accordingly, it is an object of the present invention to provide an installation for the bearing support of an inboard boat engine at a transom plate which avoids by simple means the aforementioned shortcomings and drawbacks encountered in the prior art.

Another object of the present invention resides in an installation for supporting an inboard boat engine at a transom plate which provides a more favorable and durable elastic support of the boat engine at the transom plate.

A further object of the present invention resides in an elastic support of an inboard engine at a transom plate of a boat, which not only permits a greater freedom of choice in the design of the elastic bearing support of the engine at the transom plate both in the axial and radial direction, but also permits the attainment of an effective vibration damping by means of an elastic bearing support element.

Still a further object of the present invention resides in an installation for the support of an inboard engine at a transom plate which considerably simplifies the assembly thereof.

Another object of the present invention resides in an installation for the bearing support of an inboard engine at a transom plate of a boat which considerably reduces the manufacturing costs of the transom plate and also of other parts while at the same time simplifying the speedy assembly of the various parts.

A further object of the present invention resides in a bearing support for an inboard engine at a transom plate of the type described above, which not only assures a tight seal against the entry of sea water even after long periods of operation but also permits a speedy and easy assembly of the various components thereof.

BRIEF DESCRIPTION OF THE DRAWING

These and other objects, features and advantages of the present invention will become more apparent from the following description when taken in connection with the accompanying drawing which shows, for purposes of illustration only, one embodiment in accordance with the present invention, and wherein.

DETAILED DESCRIPTION OF THE DRAWINGS

Figure 1:
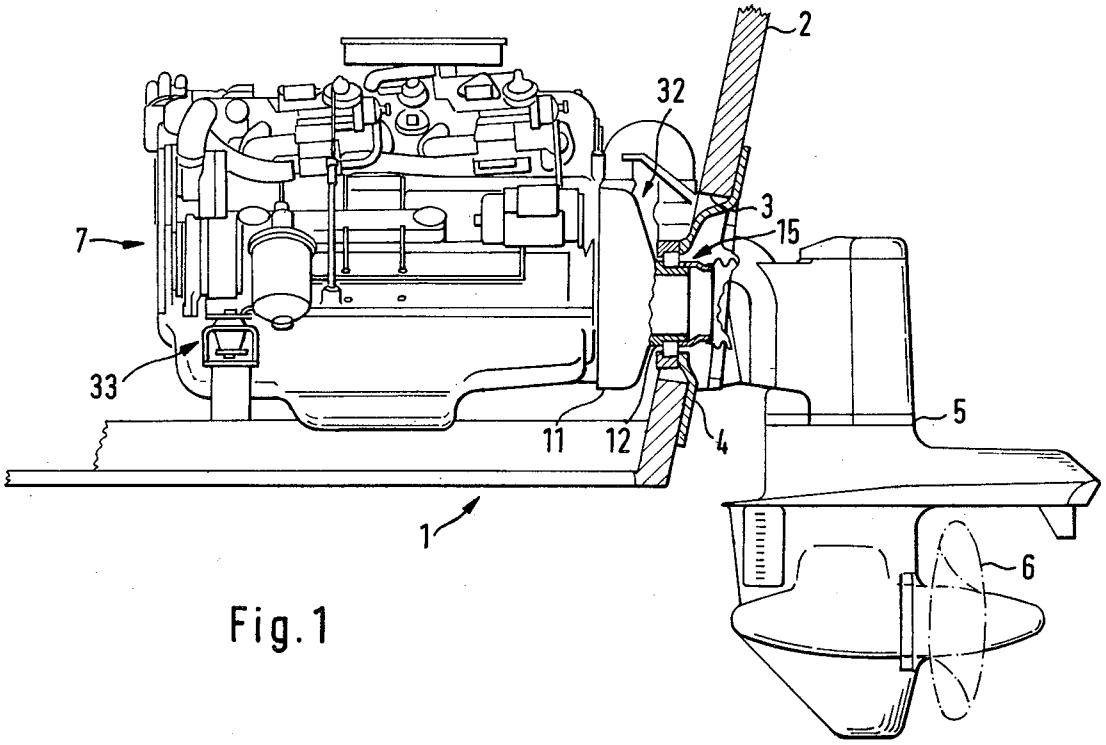
FIG. 1 is a somewhat schematic side elevational view of the rear of a boat with an inboard boat engine and an outboard drive, with the transom and transom plate shown in cross section.

Referring now to the drawing wherein like reference numerals are used throughout the various views to designate like parts and more particularly to FIG. 1, the rear of a boat generally designated by reference numeral 1, which boat is not illustrated in detail in FIG. 1, includes a boat transom 2. An aperture 3 is provided in the boat transom 2 which is covered off by a transom plate 4. A drive 5 for a propeller 6 is mounted outboard at the transom plate 4. The drive 5 is operatively connected with an engine 7 installed inboard of the boat 1 by way of a shaft extending through the transom plate 4. The connecting shaft may be constructed according to the embodiment of FIG. 2 where it is designated by reference numeral 8. The connecting shaft 8 is connected with the flywheel 9 of the boat engine 7 by way of a clutch 10. A bell-shaped member covering the flywheel 9 and the clutch 10 includes a neck 12, in which the connecting shaft 8 is rotatably supported, for example, by way of a roller bearing 13. The clutch bell 11 is preferably constructed in one piece with the neck 12 and is to be secured at the boat engine 7 in any conventional manner.

Figures 2, 3:
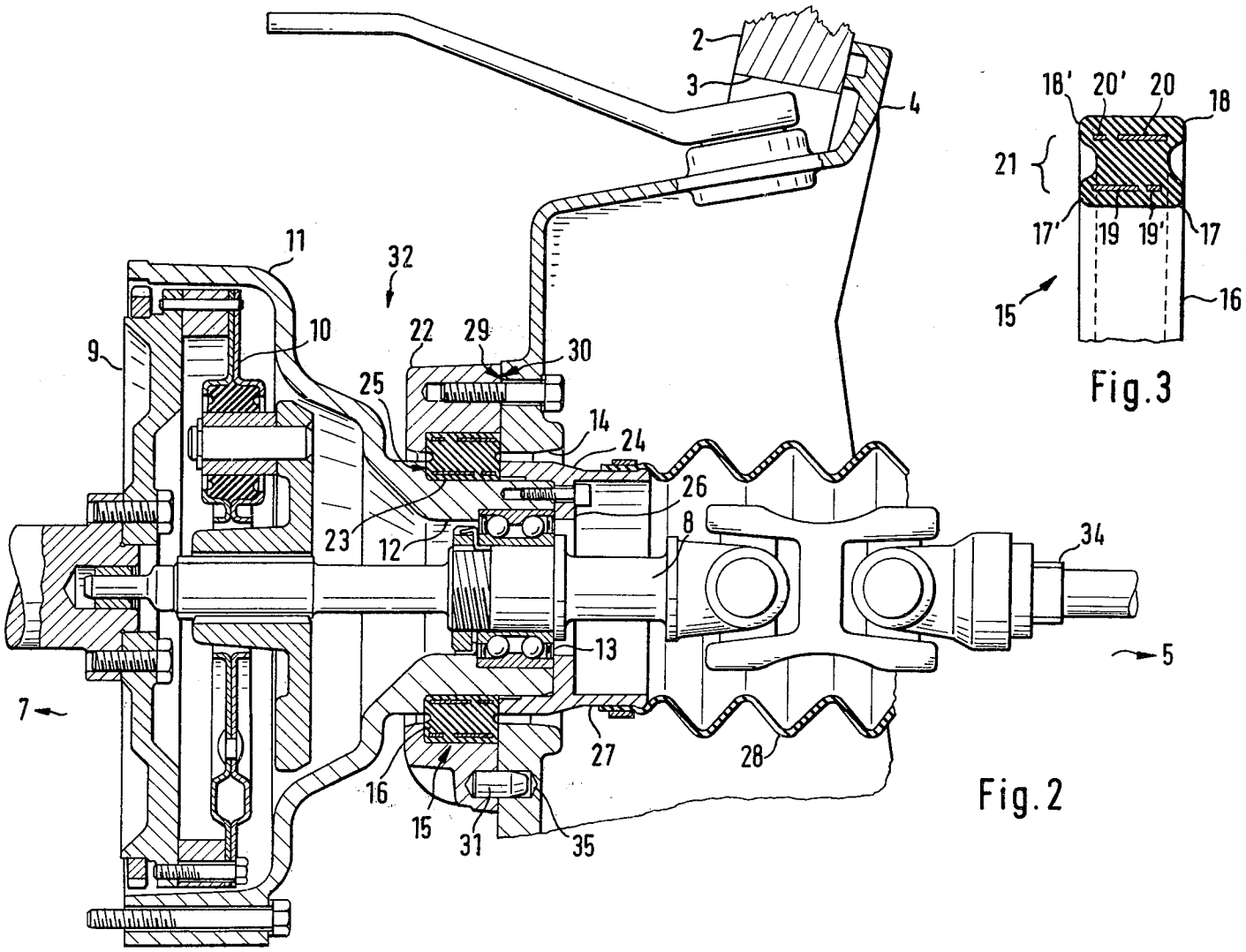
FIG. 2 is a longitudinal cross-sectional view, on an enlarged scale, of the bearing support of the boat engine at a transom plate, illustrated in FIG. 1.
FIG. 3 is a cross-sectional view through a bearing ring of the bearing support arrangement in accordance with the present invention.

In the installed condition of the boat engine 7, the neck 12 thereof is introduced into an aperture 14 of the transom plate 4. An elastic element 15 surrounding the neck 12 serves for the bearing support of the boat engine 7 at the transom plate 4. The element generally designated by reference numeral 15 is made of rubber-like material and is preferably constructed ring-shaped (FIG. 3). The bearing support ring 16 according to FIG. 3 is cylindrically constructed at the outer as also at the inner circumference. It includes at both end faces endless circumferential inner bulges or beads 17, 17' and outer bulges or beads 18, 18'. Rings 19, 19' and 20, 20' which are each arranged adjacent one another at a mutual distance, are provided between the respective beads 17, 17' and 18, 18'. The bearing ring 16 is axially clamped-in to fix it at the neck 12 as also at the transom plate 4. The rings 19 and 19' coordinated to the clamping area of the bearing ring 16 on the side of the neck and the rings 20 and 20' coordinated to the clamping area on the side of the transom plate serve each for limiting the deformation connected with the axial clamping-in action within the aforementioned clamping areas. As a result thereof, the intermediate or working area 21 of the bearing ring 16 provided for the radial and axial elasticity or yieldingness may be far-reachingly kept free in the values determined by its designer from an influence by the deformations existing in the two clamping areas. In order to keep as small as possible this influence on the working area 21 in the radial direction, all rings 19, 19', 20 and 20' conceived as inserts in the bearing ring 16 are provided as pipe sections or tubular sections which are appropriately of different length. The rings 19, 19' and 20, 20' can therewith be so coordinated to each other that the distances of adjacent rings 19, 19', respectively, 20, 20' are offset with respect to one another in the axial direction. Preferably, the rings 19, 19' on the side of the neck are arranged at a distance from the inner circumferential boundary of the bearing ring 16 and the rings 20, 20' on the side of the transom plate are arranged at a distance from the outer circumferential boundary of the bearing ring 16. As a result thereof, it follows that the material of the bulges or beads 17, 17' and 18, 18' which are deformed during the clamping-in, are forced essentially radially inwardly toward the neck 12, respectively, radially outwardly toward a clamping ring 22 adapted to be connected with the transom plate 4 within the clamping areas. This entails the advantage that the bearing ring 16 sealingly cooperates well both with the neck 12 of the boat engine 7 as also with the transom plate 4 and with the clamping ring 22.

For fixing the bearing ring 16 at the neck 12, the neck 12 includes a cylindrical offset 23. The bearing ring 16 is mounted over the offset 23 and is pressed against a step 25 in the transition area of the neck 12 to the clutch bell 11 by means of a clamping sleeve 24 centered on the offset 23. The clamping sleeve 24 includes a radially directed clamping flange 26 for the threaded connection with the neck 12. The roller bearing 13 of the connecting shaft 8 is at the same time fixed in the neck 12 by way of the clamping flange 26. Finally, the circumferentially closed clamping sleeve 24 includes an axially directed flange 27 for the fastening of a folding bellows 28 encapsulating the connecting shaft 8 between the clamping sleeve 24 and the outboard drive 5. The clamping ring 22 is provided for the fixing of the bearing ring 16 on the side of the transom plate; the clamping ring is constructed L-shaped in cross section. Preferably, the bearing ring 16 is at first assembled in the clamping ring 22, for which purpose the bearing ring 16 may more or less frictionally cooperate with the clamping ring 22. The clamping ring 22 abuts against a flat abutment surface 30 arranged inboard at the transom plate 4 by way of an end face 29 on the open side of the clamping ring 22. The clamping ring 22 is additionally centered at the transom plate 4 by way of fitting pins 31. The clamping ring 22 is secured at the transom plate 4 by way of a threaded connection to be undertaken from the outboard side whereby the bearing ring 16 is axially clamped-in on the side of the transom plate.

With the arrangement for the bearing support of an inboard boat engine 7 at a transom plate 4 for an outboard drive, illustrated in FIG. 2 in the installed condition, in addition to a completely satisfactory elastic bearing support without axial offset due to an incorrect assembly, a reliable seal, which is easy to assemble, of the aperture 14 in the transom plate 4 for the neck 12 of the boat engine 7 receiving the connecting shaft 8 is achieved.

Figure 4:
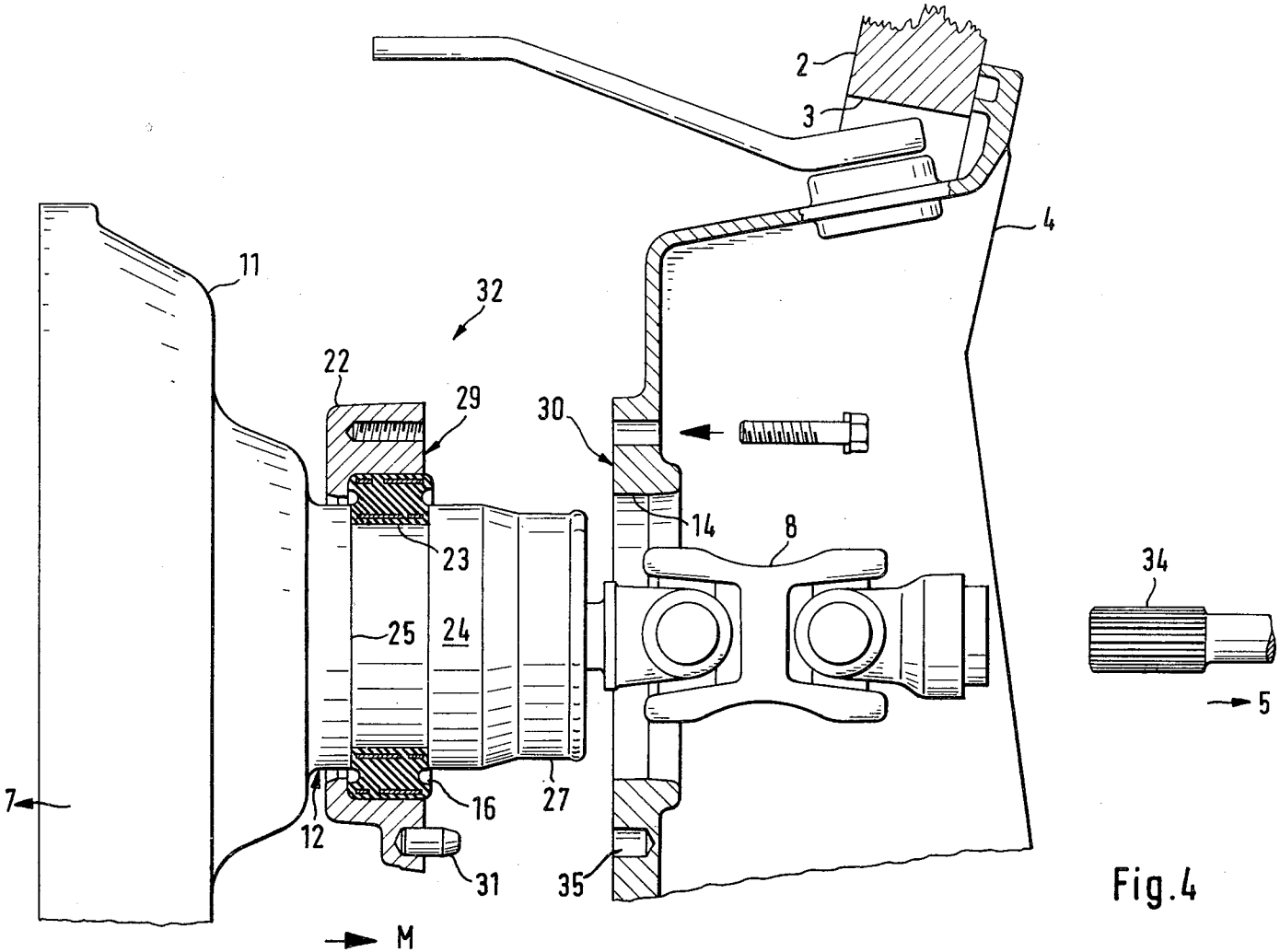
FIG. 4 is an exploded view, partly in cross section, illustrating an assembly operation of the bearing support installation at the transom plate in accordance with the present invention.

As already mentioned above, the clamping ring 22 and the bearing ring 16 form an assembly unit. The clutch bell 11 with the connecting shaft 8 retained in the neck 12 by way of the roller bearing 13 forms a further assembly unit. Both assembly units together, whereby the clamping sleeve 24 fixes the first assembly unit at the second assembly unit as well as the connecting shaft 8 by way of the roller bearing 13 at the clutch bell 11, produce the next larger assembly unit which is designated in FIG. 4 by reference numeral 32. The assembly unit 32 is connected with the boat engine 7, which is equipped with further elastic supports in its other end section on both sides. One further elastic support designated by reference numeral 33 can be recognized in FIG. 1. A boat engine 7 which is supplied completely in this manner by the manufacturer, during its installation into the boat 1 is to be introduced with its neck 12 into the aperture 14 of the transom plate 4—with the connecting shaft 8 first—and is to be threadably connected with the transom plate 4 from the outboard side exclusively by way of the clamping ring 22—the connecting shaft 8 is already coupled by means of a spline tooth arrangement with a drive tunnel 34 of the outboard drive 5. Fitting pins 31 center by way of the clamping ring 22 and fitting bores 35 in the transom plate 4, the boat engine 7 to the drive tunnel 34 of the outboard drive 5 during the assembly in the direction according to the arrow "M." The shortest possible assembly time and a completely satisfactory alignment of the boat engine 7 with the outboard drive 5 are assured therewith. Also, a simple assembly of the folding bellows 28 is assured by the construction of the bearing support arrangement of the boat engine 7 at the transom plate 4 in accordance with the present invention.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. An installation for the support of an inboard engine at a transom plate connected with a boat transom for an outboard drive means, comprising neck means secured at the boat engine and receiving a connecting shaft between the boat engine and the drive means, said neck means being inserted into an aperture of the transom plate, and elastic means surrounding said neck means operatively connecting the latter with the aperture in the transom plate, said elastic means being retained at the neck means by an axial clamping-in action in its inner circumferential area, characterized in that the elastic means is retained at the transom plate by an axial clamping-in action in its outer circumferential area, and in that a radially and axially yielding section free of clamping means is provided between the two clamping areas and wherein said elastic means includes in both clamping areas a pressure-resistant means limiting the deformation of the elastic means by the axial clamping-in action, the pressure-resistant means in each clamping area including a plurality of inserts which are spaced axially with respect to one another.

2. An installation according to claim 1, characterized in that the elastic means is constructed ring-shaped and constitutes a bearing ring means having endless circumferential beads at the end faces within the clamping areas.

3. An installation according to claim 2, characterized in that said inserts are rings.

4. An installation according to claim 2, characterized in that said bearing ring means is frictionally retained by way of its outer circumference in a recess of a clamping ring means constructed approximately L-shaped in cross section and is axially clamped-in against an abutment surface arranged inboard thereof at the transom plate by way of the clamping ring means.

5. An installation according to claim 4, characterized in that the clamping ring means is guided by centering means and in that threaded means provided from the other side are used to axially clamp-in the bearing ring means against the abutment surface.

6. An installation according to claim 5, characterized in that the abutment surface at the transom plate is arranged inboard and the threaded means of the clamping ring means is provided from the outboard side.

7. An installation according to claim 1, characterized in that the elastic means is constructed ring-shaped of rubber-like material and constitutes a bearing ring means having endless circumferential beads at the end faces within the clamping areas, said means for limiting deformation being provided between said beads in the bearing ring means.

8. An installation according to claim 7, characterized in that said bearing ring means is frictionally retained by way of its outer circumference in a recess of a clamping ring means constructed approximately L-shaped in cross section and is axially clamped-in against an abutment surface of the transom plate by way of the clamping ring means.

9. An installation for the support of an inboard engine at a transom plate connected with a boat transom for an outboard drive means comprising neck means secured at the boat engine and receiving a connecting shaft between the boat engine and the drive means, said neck means being inserted into an aperture of the transom plate, and elastic means surrounding said neck means operatively connecting the latter with the aperture in the transom plate, said elastic means being retained at the neck means by an axial clamping-in action in its inner circumferential area, characterized in that the elastic means is retained at the transom plate by an axial clamping-in action in its outer circumferential area, and in that a radially and axially yielding section free of clamping means is provided between the two clamping areas; said elastic means includes in both clamping areas a pressure-resistant means limiting the deformation of the elastic means; said elastic means is constructed ring-shaped of rubber-like material and constitutes a bearing ring means having endless circumferential beads at the end faces within the clamping areas, the means for limiting deformation being provided between beads in the bearing ring means adjacent one another at a mutual distance on the neck side as also on the transom side; said bearing ring means is frictionally retained by way of its outer circumference in a recess of a clamping ring means constructed approximately L-shaped in cross section and is axially clamped-in against an abutment surface of the transom plate by way of the clamping ring means; said clamping ring means is guided by centering means and threaded means are used to axially clamp-in the bearing ring means against the abutment surface; said bearing ring means and said clamping ring means are combined together with a clutch bell including the neck means and are adapted to be secured at the boat engine into an assembly unit, and a clamping sleeve means which is centered at the neck and which presses the bearing ring means in its clamping place on the side of the neck means against a step in the transition area from the neck means to the clutch bell, includes a flange means for a folding bellows arranged essentially coaxially to the connecting shaft.

10. An installation for the support of an inboard engine at a transom plate connected with a boat transom for an outboard drive means, comprising neck means secured at the boat engine and receiving a connecting shaft between the boat engine and the drive means, said neck means being inserted into an aperture of the transom plate, and elastic means surrounding said neck means operatively connecting the latter with the aperture in the transom plate, said elastic means being retained at the neck means by an axial clamping-in action in its inner circumferential area, characterized in that the elastic means is retained at the transom plate at the transom plate by an axial clamping-in action in its outer circumferential area, and in that a radially and axially yielding section free of clamping means is provided between the two clamping areas; said elastic means is constructed ring-shaped of rubber-like material and constitutes a bearing ring means having endless circumferential beads at the end faces within the clamping areas, means for limiting deformation being provided between said beads in the bearing ring means; said bearing ring means is frictionally retained by way of its outer circumference in a recess of a clamping ring means constructed approximately L-shaped in cross section and is axially clamped-in against an abutment surface of the transom plate by way of the clamping ring means; the bearing ring means and the clamping ring means are combined together with a clutch bell including the neck means and are adapted to be secured at the boat engine into an assembly unit, and a clamping sleeve means which is centered at the neck means and which presses the bearing ring means in its clamping place on the side of the neck means against a step in the transition area from the neck means to the clutch bell, includes a flange means for a folding bellows arranged essentially coaxially to the connecting shaft.

11. An installation for the support of an inboard engine at a transom plate connected with a boat transom for an outboard drive means, comprising neck means secured at the boat engine and receiving a connecting shaft between the boat engine and the drive means, said neck means being inserted into an aperture of the transom plate, elastic means surrounding said neck means and operatively connecting the latter with said transom plate by first clamping means clamping said elastic means to the neck means by an axial clamping-in action in an inner circumferential area of the elastic means and by second clamping means clamping said elastic means to the transom plate by an axial clamping-in action in an outer circumferential area of the elastic means, a radially and axially yielding section free of clamping means being provided between the two clamping areas and wherein said elastic means includes in both clamping areas a pressure-resistant means limiting the deformation of the elastic means by the axial clamping-in action, the pressure-resistant means in each clamping area including a plurality of inserts which are spaced axially with respect to one another.

* * * * *